US010912985B2

(12) United States Patent
Barton

(10) Patent No.: US 10,912,985 B2
(45) Date of Patent: Feb. 9, 2021

(54) LACES WITH TYING MECHANISMS AND RELATED METHODS

(71) Applicant: Richard Barton, Santa Ana, CA (US)

(72) Inventor: Richard Barton, Santa Ana, CA (US)

( * ) Notice: Subject to any disclaimer, the term of this patent is extended or adjusted under 35 U.S.C. 154(b) by 269 days.

(21) Appl. No.: 15/914,645

(22) Filed: Mar. 7, 2018

(65) Prior Publication Data

US 2018/0369679 A1 Dec. 27, 2018

Related U.S. Application Data

(60) Provisional application No. 62/523,573, filed on Jun. 22, 2017.

(51) Int. Cl.
*A63B 71/14* (2006.01)

(52) U.S. Cl.
CPC ..... *A63B 71/145* (2013.01); *A63B 2209/10* (2013.01); *A63B 2244/102* (2013.01)

(58) Field of Classification Search
CPC ..... A63B 71/145; A43C 7/00; A43C 7/005; A43B 5/00; A41D 19/0044; A41D 19/0048
USPC ..... 2/18, 158, 159, 161.1, 161.4, 123, 124, 2/162, 170
See application file for complete search history.

(56) References Cited

U.S. PATENT DOCUMENTS 4,424,595 A * 1/1984 Albert ..... A63B 71/145 2/18
6,178,553 B1 * 1/2001 Bolton ..... A63B 71/145 2/18
6,202,213 B1 * 3/2001 Georgick ..... A63B 71/145 2/161.1
6,295,704 B1 * 10/2001 Rivas ..... A43C 7/06 24/306
6,704,936 B1 * 3/2004 Carlin ..... A63B 71/145 2/161.1
D732,747 S * 6/2015 Phillips ..... D29/116.1
2008/0083136 A1 * 4/2008 McNeely ..... A41F 17/02 36/70 R
2013/0283639 A1 * 10/2013 Williams ..... A43C 7/02 36/83
2015/0287475 A1 * 10/2015 Kim ..... G11C 17/18 365/96
2017/0282048 A1 * 10/2017 Wittman ..... A63B 71/145

* cited by examiner

*Primary Examiner* — Gloria M Hale
(74) *Attorney, Agent, or Firm* — Klein, O'Neill & Singh, LLP

(57) ABSTRACT

Laces and tying mechanisms can be used with boxing gloves and shoes to allow a user to secure the laces without a second person and/or without tying a knot. A tying mechanism can include a back-to-back hook and loop fastener element or can be a separate hook element and a loop element. Lace overhang sections of a lace can connect to the tying mechanism to enable a person to lace up his or her gloves, or shoes, while having two hands inside the gloves without the aid of another person.

21 Claims, 8 Drawing Sheets

FIG. 8
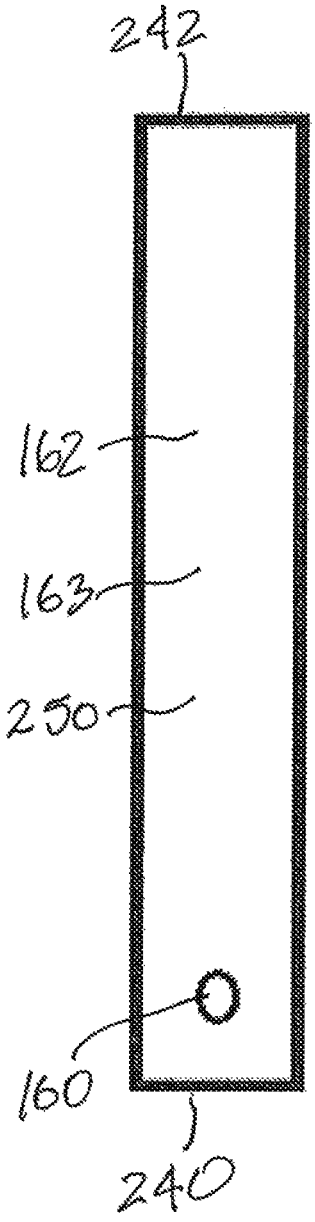
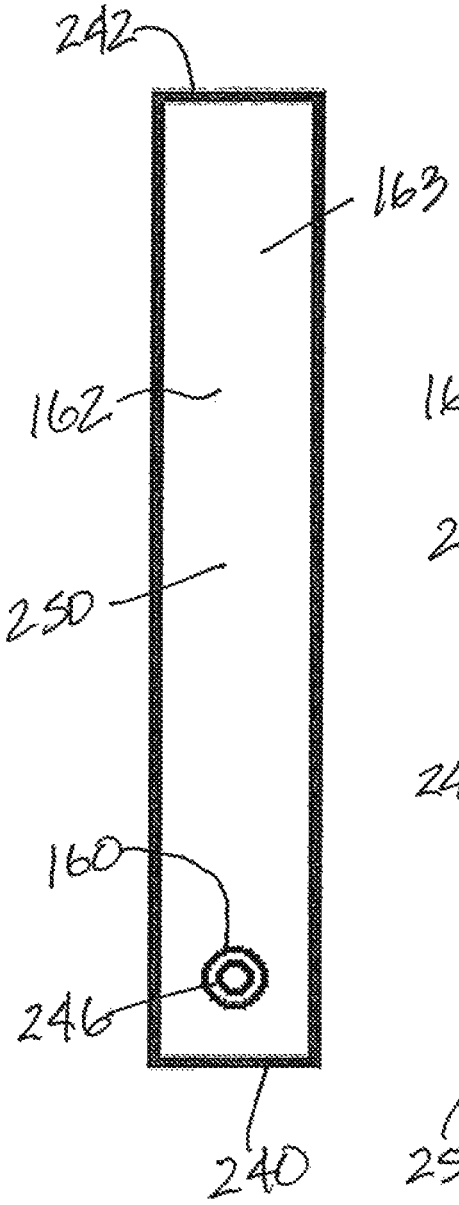
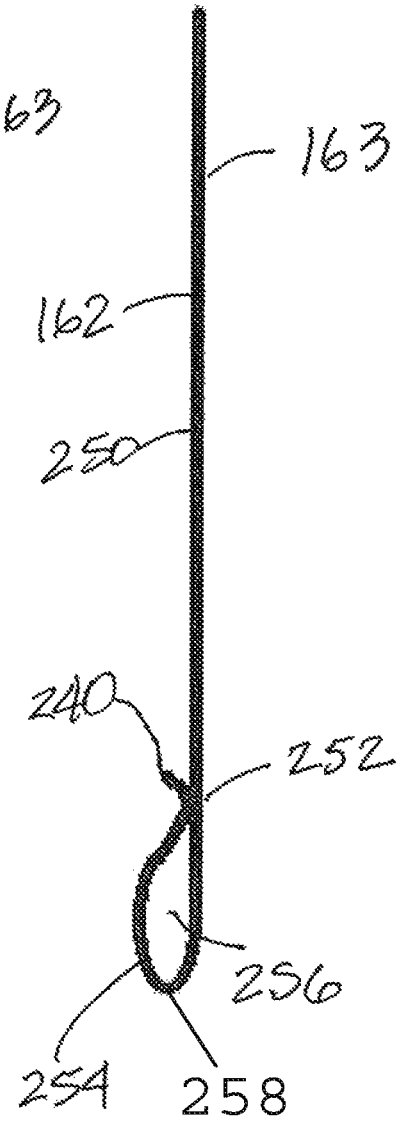
FIG. 7
FIG. 9

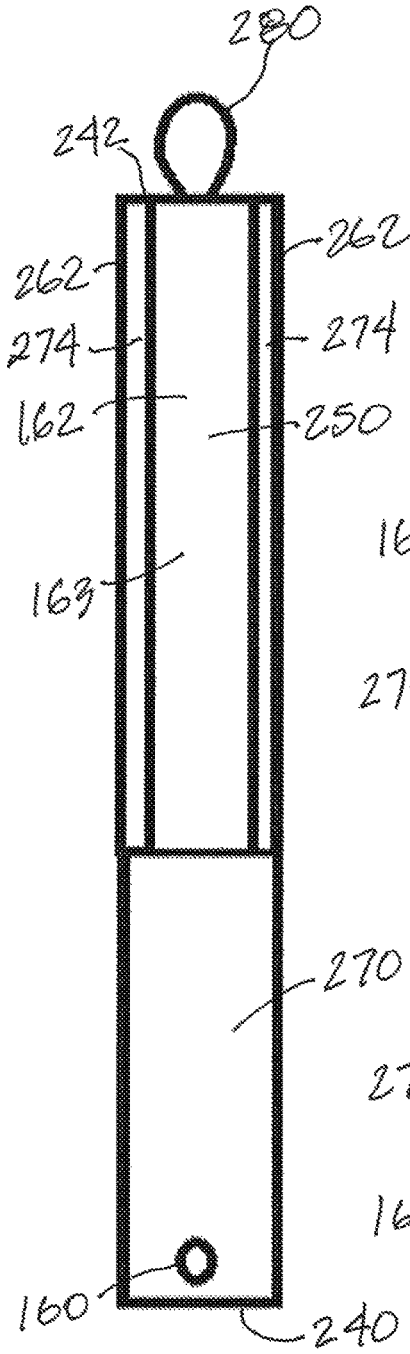
FIG. 10
FIG. 11
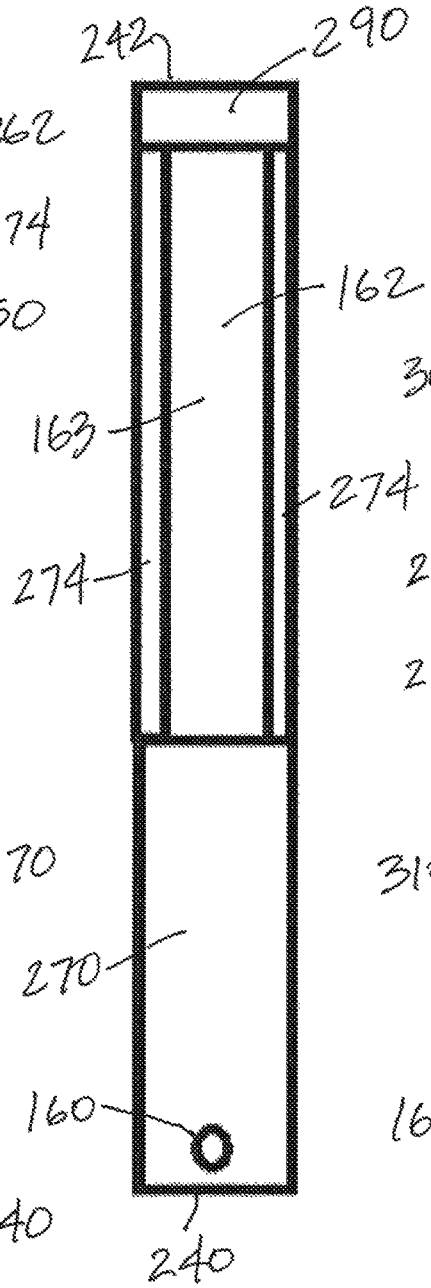
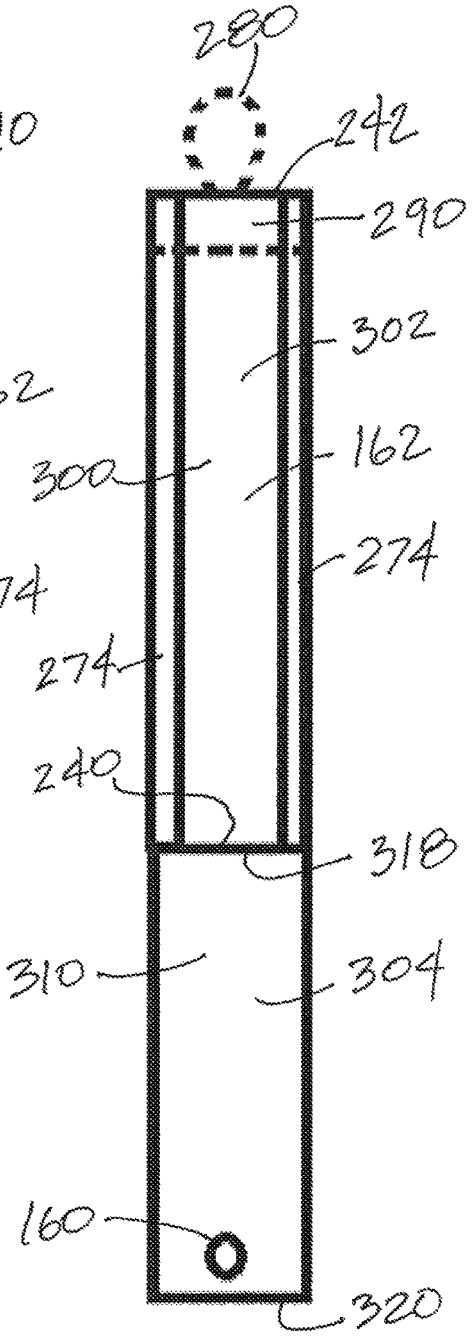
FIG. 12

LACES WITH TYING MECHANISMS AND RELATED METHODS

FIELD OF ART

The present invention is generally directed to laces, such as shoe laces or shoes strings, to boxing glove laces, applications thereof, and to laces with tying mechanisms and related methods.

BACKGROUND

Tying shoe laces is a part of life that everyone learns to master. It is a simple and trivial enough task that few people ever stop to contemplate its integral part of everyday life. However, when an individual has physical limitations, limited dexterity, or limited mobility, tying shoe laces for a pair of shoes can be challenging.

Another similar scenario is the use of boxing gloves. When a boxer puts on a pair of gloves, her fingers are covered and her dexterity and mobility to tie her own gloves are impaired. Thus, in a boxing environment, a boxer typically requires another person to assist in tying the boxer's gloves. Once tied, the ends of each lace are typically taped to the cuff part of the respective boxing glove to prevent unwanted untying of the loose ends.

SUMMARY

Aspects of the present invention include a boxing glove, said boxing glove comprising: a body with a finger portion, a palm portion, a thumb portion, and a base portion having an opening for placement of a hand inside an interior of the body; a plurality of eyelets or openings having a lace passing through at least a subset of the eyelets or openings, said lace comprising two overhang lace sections and two free ends; and a fastener element having a body and wherein the two overhang lace sections are attached to the body of the fastener element.

The fastener element can be a back-to-back hook and loop element.

The fastener element can be a hook element and a separate loop element.

The terms hook element and loop element are understood to be two elements of a fastener system wherein the hook element and the loop element can engage to function as a fastener or a securement device.

A strip of a hook element can be referred to its shorthand version as simply a hook element.

A strip of a loop element can be referred to its shorthand version as simply a loop element.

A cover element having a protective surface can attach to the fastener element.

At least one edge liner can attach to an edge of the fastener element.

A gripper element can attach to an end of the fastener element.

The fastener element can have a first section attached to a second section and the second section attached to a third section, and wherein the second section can be made from a stretchable material.

The first section can comprise a hook element and the third section can comprise a loop element.

A gripper element or a gripper pad can attach to the first section and an eyelet can be located at the third section.

The fastener element can have an overall length of between 8 inches to 24 inches.

Aspects of the present invention further include a method for lacing up a boxing glove. The method can comprise: placing a hand through an interior of the boxing glove; pulling on the lace to create tension on the lace, said lace comprising at least one overhang lace section attached to a fastener element; wrapping the lace and the fastener element around a base portion of the boxing glove; and securing the lace without a knot on the at least one overhang lace section.

A further aspect of the invention is a method for lacing up a boxing glove comprising: placing a hand through an interior of the boxing glove; pulling on the lace to create tension on the lace, said lace comprising two overhang lace sections attached to back-to-back hook and loop element comprising an opening; wrapping the lace and the back-to-back hook and loop element around a base portion of the boxing glove; and securing the lace without by engaging the hook and the loop at the base portion.

A further aspect of the present invention includes a fastener element for use with a lace having two overhang lace sections comprising: a body having a length and a width made from a hook element, a loop element, or a back to back hook and loop element; a cover element attached to the body, the cover element having a softer surface than a hook element of a hook and loop system; and a hole formed through the cover element for receiving at least part of a lace.

The body can have a first edge and a second edge and wherein the cover element can attach at or near the first edge or the second edge.

The body can have a side edge and wherein an edge liner can attach to the side edge.

A stretchable intermediate piece can be located between the hook element and the loop element.

A still further aspect of the present invention can include a method for lacing up a boxing glove comprising: placing a hand through an interior of the boxing glove; pulling on a lace to create tension on the lace, said lace comprising at least one overhang lace section attached to a fastener element; wrapping the lace and the fastener element around a base portion of the boxing glove; and securing the lace and maintaining the tension by securing a first portion of the fastener to a second portion of the fastener element.

The first portion of the fastener element can attach to an intermediate piece and the second portion of the fastener element can attach to the intermediate piece.

The at least one overhang lace section can project through an eyelet located with the second portion and a second overhang lace section projects through the eyelet.

The first portion of the fastener element can comprise a hook element and a backing and the second portion of the fastener element can comprise a loop element and a cover element. The intermediate piece can be made from a stretchable material.

The method can further comprise the step of grasping a second fastener element secured to a second boxing glove using the hand located inside a first boxing glove.

Methods of making and of using the fastener elements and components thereof of the present disclosure are within the scope of the present invention.

Fastener elements of the present invention can be used with laces found in shoes and boxing gloves, among others. A pair of boxing gloves can include a right handed boxing glove and a left handed boxing glove. The boxing gloves can be any number of commercially available boxing gloves and can include sparing gloves, bagging gloves, and competing gloves.

A typical boxing glove comprises a body, such as a glove body, with a finger portion, a palm portion, a thumb portion, a wrist portion, and an opening portion, which has an opening or inlet for inserting a boxer's hand into the interior of the glove body. Together, the wrist portion and the opening portion can be called a base portion.

In an example, the base portion can have an elongated slit or channel defined by two flaps with each flap having a plurality of eyelets. A tongue can be provided between the two flaps to provide a barrier between the flaps and the skin.

The eyelets can simply be small holes or openings formed through the material of the two flaps and usable for threading a lace or a string therethrough to retain the two flaps together. In other examples, the eyelets can be reinforced metal eyelets and can each comprise small metal pieces to reinforce a corresponding opening on the two flaps.

Grommets are similar to reinforced metal eyelets but typically used for more heavy duty material. Unless the context indicates otherwise, a lace and a string can be used synonymously, a slit and a channel at the base portion can be used synonymously, and an eyelet and a grommet can be used synonymously. An eyelet as used herein can be a small opening or an opening reinforced by one or more metal pieces to produce a reinforced opening.

Further, the terms first and second and left and right are used as reference points only and not structurally limiting unless the context indicates otherwise. For example, an object can have a first end and a second end and the reference "first" and "second" identified for reference purposes to describe aspects of the object. The only restriction is that once an end has been called or selected to be a "first" end, then the same end cannot also be a "second" end. Similar to the terms left and right and up and down.

A single lace can pass through the plurality of eyelets in a typical crossing pattern. In other examples, the stringing pattern or lacing pattern can be different, such as a knotted lacing pattern, a ladder lacing pattern, a hash lacing pattern, a diagonal lacing pattern, a bow tie lacing pattern, or a straight lace pattern. In still other examples, more than one lace can be used to lace through the eyelets.

A typical lace can have a length that is sufficient to lace through the eyelets of the two flaps of a boxing glove, or a shoe, and extend beyond the last eyelet of each flap with two overhang lace sections. Each overhang lace section has a terminal end or free end with a reinforced tip, which is typically reinforced by tape, plastic coating, or similar elements. The two free ends can remain free prior to coupling to a fastener element or can be tied or connected to one another prior to coupling to the fastener element.

The lace should be long enough so that the two overhang lace sections can wrap at least partially around the base portion of the glove. In some examples, the two overhang lace sections can wrap around at least one full revolution around the base portion of the boxing glove, such as 1 to 1.2 revolutions, 1.5 revolutions, 2 revolutions, or a higher number of revolutions.

In an example, the two overhang lace sections are passed through an opening or through hole of the anchoring mechanism or fastener element. In alternative embodiments, two or more openings are provided with the fastener element for looping the two overhang lace section therethrough to secure the lace to the fastener element. Each overhang section can loop through a respective opening of the multiple openings fastener element, when two or more openings are incorporated, or in any pattern or method desired by the user for purposes of tying the lace to the fastener element.

In an example, a back-to-back hook and loop element can form the basis of the fastener element, for example a VELCRO® brand hook and loop length. A hook and loop element having a length of about 8 inches to about 24 inches may be used with the lace with other dimensions contemplated, such as being shorter than 8 inches or longer than 24 inches.

The hook and loop width can be about ¾ inch to about 1.5 inches with other dimensions contemplated, such as being less than ¾ inch or greater than 1.5 inches. A back-to-back hook and loop system forming the fastener element of the present disclosure has the hook on one side or face of a strip and the loop on the other side or face of the strip of the fastener system. The hook is understood to be the rougher of the hook/loop fastening system, and the loop the softer of the two materials.

The hole on the fastener element can be reinforced, such as with a metal eyelet. In other examples, there can be two or more holes formed through the fastener element so as to distribute the pulling forces over larger areas of the fastener element.

In use, a boxer, or a person that plans to wear the boxing gloves can place his or her hand in through the opening portion of the glove and into the interior of the body and then pull on the two overhang lace sections of the lace to pull the two flaps together so as to tighten the base portion around the boxer's wrist and forearm.

The boxer can then wrap the overhang lace sections around the base portion of the glove while maintaining a firm grip on the lace so as to hold the lace in tension around the base portion. Once the two overhang lace sections are taken up by the partial, full, or greater than one wrapping revolution around the base portion, the boxer can then continue to wrap the hook and loop system of the fastener element around the base portion of the glove until the hook and the loop of the fastener element can engage one another.

The lace can be tightened around the glove when the fastener element attaches to itself to maintain the lace in the wrapped position. The engagement between the hook and loop of the fastener element keeps the lace tightly wrapped around the base portion of the glove without the need for a second person. Different fastener elements as described elsewhere herein can be used in the manner described.

After the boxer successfully secures the lace of the first boxing glove as described herein, the boxer can now place his or her left hand into the second boxing glove and repeat the securing steps. Because no special dexterity is required to take up the tension of the lace and maintain the tension, as the lace is not required to be tied or knotted to maintain the tension around the base section, the boxer can repeat the securing steps by gripping the lace and/or the fastener element on the second boxing glove using the thumb portion and the finger/palm portions of the first boxing glove, with the left or right hand located therein, to secure the lace of the second boxing glove with the other hand located in the second boxing glove.

The boxer can start with either hand. Thus, the first boxing glove can be a right-handed boxing glove or a left-handed boxing glove and the second boxing glove can be the other one of the right-handed boxing glove or the left-handed boxing glove.

Once completed, the boxer is able to put on both the left and right handed boxing gloves by himself or herself without the aid of a second person to tie or knot the ends of the lace together, which is impossible to do without the aid of the lace and fastener element of the present embodiments.

Although the description refers to placement of the right hand into the right handed boxing glove first and then follow by the left hand into the left handed glove, the invention can be practiced in reverse, starting with the left hand and then the right hand.

An opening can be formed with a puncher to create a hole near a first end of a fastener element, opposite a second end of the fastener element. The fastener element can be formed with a back to back hook and loop element or the body can be formed by attaching a strip of hook element to a strip of a loop element, in an end-to-end or serial configuration, with or without an intermediate piece therebetween.

The opening or through hole can be reinforced with a metal eyelet.

The first end of the fastener element can be wrapped around and attached to the body of the fastener element at an attached point, such as with stitching, sewing, bonding, and/or adhesive. This wrapped section in combination with the attached point can form a body loop near the first end of the fastener element.

Two free ends of a lace can pass through the body loop and then tied off to mechanically secure the lace to the fastener element. The fastener element of the present disclosure can be formed with a back to back hook and loop element or the body can be formed by attaching a strip of hook element to a strip of a loop element, in an end-to-end or serial configuration, with or without an intermediate piece therebetween.

In some examples, a lace can be laced through a plurality of eyelets on a shoe or a boxing glove differently than as shown and described herein and is still usable with a fastener element of the present invention. For example, the lace can be laced so that there is only one lace overhang and the one lace overhang connected to the fastener element described elsewhere herein.

In still other examples, the lace can have a different lacing pattern than the crossing pattern shown. In still other examples, after lacing a boxing glove or a shoe as described elsewhere herein, tape can be used to further secure the fastener element from inadvertently coming loose or coming undone.

A cover element can attach to the body of the fastener element, such as by stitching, sewing, adhesive, welding, or combinations thereof. The cover element can be attached closer to the first end of the body than the second end of the body. An opening can be provided through both the cover element and the body of the fastener element to receive one or two free ends of a lace. A reinforced metal eyelet can be included with the opening.

The cover element can function as a smooth protective layer or surface and can embody any number of materials, including VELCRO compatible neoprene, neoprene, closed cell foam, polyester tricot loop, nylon knitted loop, nylon tricot, low pile loop fabric, unbroken loop fabric, Spandex and nylon jersey, Spandex and polyester Perfectex, Lycra fabric, heavy duty cotton, low density ethylene foam, and polyethylene foam. The cover element is understood to have a relatively softer surface than that of the hook element and softer than the edges of the hook element or loop element.

The cover element can be incorporated so that when the lace and fastener element are wrapped around an object, such as around an extended ankle support system of a shoe or around a base portion of a boxing glove, the cover element does not scratch or otherwise damage the surfaces that the cover element comes into contact.

The cover element can have a width that matches or closely corresponds to the width of the body of the fastener element. The length of the cover element can be selected so that some or all of the circumference to which the fastener element wraps around, such as the base portion of a boxing glove, contacts the cover element. In an example, the cover element is attached to the hook side of a back-to-back hook and loop element, such as by stitching, sewing, bonding, adhesive, or combinations thereof.

The present fastener element can include two edge liners, one on each side edge of the fastener element. Each edge liner can be a woven or non-woven cloth or fabric and can be attached to the respective side of the body by sewing, stitching, adhesive, bonding, or combinations thereof. In other examples, the two edge liners can be made from a thermoplastic foam material. The two edge liners can protect a user or wearer from the relatively hard surface of the edges of the body to prevent unwanted injuries or pain.

The two edge liners can extend the remaining length of the body along the two edges not covered by the cover element or can extend the full length of the fastener element or any length in between. In an example, the two edge liners can be made from a polyester fabric or material.

Optionally, a gripper element may be included at or near the second end of the body. The gripper element can be attached to the loop side of the fastener element so as to leave the hook side of the fastener element exposed at the second end for securing against the loop element when the fastener element is wrapped around an object, such as around the base of a boxing glove. When incorporated, the gripper element provides a leverage point to facilitating separating the hook element from the loop element.

The gripper element, when incorporated, can embody a loop with a hole or opening in the middle thereof. In other examples, the gripper element is an enlarged gripping structure or fabric for grabbing and pulling, with or without a loop. The gripper element can be made from any number of materials, including from a woven or non-woven strip of fabric or cloth or from a string. In an example, the gripper element is made from a polyester material.

A gripper pad can alternatively be provided at the second end of the gripper element. In an example, the gripper pad is stitched, sewn, bonded, or glued to the body, including to the hook side of the fastener element. The gripper pad, which can have the same material as the cover element or the edge liners or be made from a different material, can be used by the user or wearer to pry the hook from the loop of the fastener element to separate the fastener element from the object, such as from the boxing glove or shoe.

The overall length of the fastener element can be made from at least two distinct materials or sections. The first section can be made from a hook element having a first end and a second end. Optionally, the first section can be a back-to-back hook/loop element. The second section can be made from a loop element with a built-in loop that is compatible with the hook element of the first section or from a loop element. For example, the loop element can be a VELCRO hook/loop system, neoprene, polyester tricot loop, nylon knitted loop, low pile loop fabric, unbroken loop fabric, etc.

The second section can have a first end attached to the first end of the first section and a second end spaced from the first end. The first end of the first section and the first end of the second section can overlap and the stitching or sewing performed at the overlapped sections. The opening, which can be reinforced with a metal eyelet, is located closer to the second end than to the first end of the loop element. For simplicity, the first section can be considered a hook element and the second section can be considered a loop element.

A cover element, similar to those shown and described elsewhere, can be attached to the second section to provide cushion, padding, or coverage upon contact with the shoe or boxing glove.

The first section of the fastener element may incorporate a gripper element or a gripper pad. Optionally, the gripper element and/or the gripper pad can be omitted. The first section and the second section may attach to one another by stitching, sewing, bonding, adhesive or combinations thereof.

Thus, a fastener element described herein can have an overall length defined by a hook element, a loop element, or a combination hook/loop element. Optionally, an intermediate piece can be provided between a strip of a hook element and a strip of a loop element. The intermediate piece can be a stretchable material, an elastic belt, or a fabric. In other examples, the overall length of a fastener element can be defined by two or more distinct sections. For example, a length of the fastener element can be a loop element and another length of the fastener element can be a hook element, a loop element, or a combination hook/loop element.

A further aspect of the present invention includes a fastener element made from a first section attached to a second section, which is then attached to a third section. The first section can overlap with the second section at a first overlapped region. The first section and the second section can be secured together at the first overlapped region by stitching, sewing, bonding, adhesive or combinations thereof.

The second section can overlap with the third section at a second overlapped region. The first section and the second section can be secured together at the second overlapped region by stitching, sewing, bonding, adhesive or combinations thereof.

The fastener element can have a body defined by the three sections. The body can have a first end and a second end.

An opening can be provided with the body near the first end. The opening can be a simple hole punched through the third section or can be reinforced with a metal eyelet.

A gripper element or a gripper pad can be provided and attached to the second end of the body. In an example, the body is provided with a gripper pad, which can overlap with the first section at a third overlapped region. The first section and the gripper element or gripper pad can be secured together at the third overlapped region by stitching, sewing, bonding, adhesive or combinations thereof.

The first section of the fastener element can be made from a strip of a hook element for attaching to a loop element. The length of the first section can be about 3 inches to about 11 inches in length. The hook element can optionally be provided with a backing material. The backing material can attach to the hook element around a perimeter of the hook element, such as by stitching, sewing, bonding, adhesive, or combinations thereof.

In an example, the backing material can be made from a synthetic textile such as a from a nylon material, a polyester material or from Nomex. Optionally, the backing material can be made from heavy duty cotton. In some examples, the exterior surface of the backing material can be printed or labeled with any number of information, such as manufacturer information, team logo, personalized prints, etc. When the fastener element is put to use, the exterior surface and the optional printed information can be exposed and visually detectable.

In an example, the second section can have a structure or body that is stretchable. For example, the second section can be made from a stretchable material, an elastic belt, from Lycra, from Spandex, from Nylon Lycra fabric, or similar two dimensional or four dimensional stretchable fabrics. The second section, which can also be referred to as an intermediate piece, can have a length of between about 1.5 inches to about 6 inches.

In some examples, there can be more than one strip of stretchable material used for the second section. For example, there can be two or more overlapping strips, or a long strip that is folded, to provide bulk and greater biasing force than a single strip of the same construction.

The third section can have two side edges with each of the two side edges having an edge liner attached thereto. The third section can include a trip of a loop element and a cover element. The cover element is similar to cover elements described elsewhere herein.

A through hole or eyelet, which can be a punched hole or a metal reinforced eyelet, can be provided near an end of the third section. Overhang lace sections of a lace can project through the eyelet and secured thereto by knotting. In some examples, there can be two or more eyelets for coupling with the overhang lace sections.

The hook element can oriented in a first direction while the loop element oriented in a second direction, opposite the first direction. This arrangement allows the fastener element to wrap around an object, such as a boxing glove, with the cover element in contact with the object so that the loop element is exposed for engagement by the hook element. The length of the third section can be approximately 6 inches to about 14 inches.

In an example, the second section or intermediate piece projects between the cover element and the loop element of the third piece and then secured between the two by stitching, sewing, bonding, adhesive or combinations thereof. In other examples, the intermediate piece can lie over or under the third section and not between the cover element and the loop element of the third piece.

The fastener elements described herein can be viewed as having a first portion configured for attaching to a second portion of the fastener element. The first portion of the fastener element can attach to an intermediate piece and the second portion of the fastener element can attach to the intermediate piece. The first portion and the second portion can attach to one another through the intermediate piece.

The intermediate piece can comprise a single element or a single body or more than one elements having multiple separate pieces that are attached together. The first portion and the second portion are indirectly attached to one another. Optionally, the first portion and the second portion are directly attached to one another and the intermediate piece is omitted.

BRIEF DESCRIPTION OF THE DRAWINGS

These and other features and advantages of the present devices, systems, and methods will become appreciated as the same becomes better understood with reference to the specification, claims and appended drawings wherein:

FIGS. 7-9 are schematic depictions of different embodiments of a fastener element.

FIGS. 10-12 are schematic depictions of further alternative embodiments of a fastener element.

DETAILED DESCRIPTION

The detailed description set forth below in connection with the appended drawings is intended as a description of the presently preferred embodiments of laces with tying mechanisms, and said laces in combination with shoes or boxing gloves provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
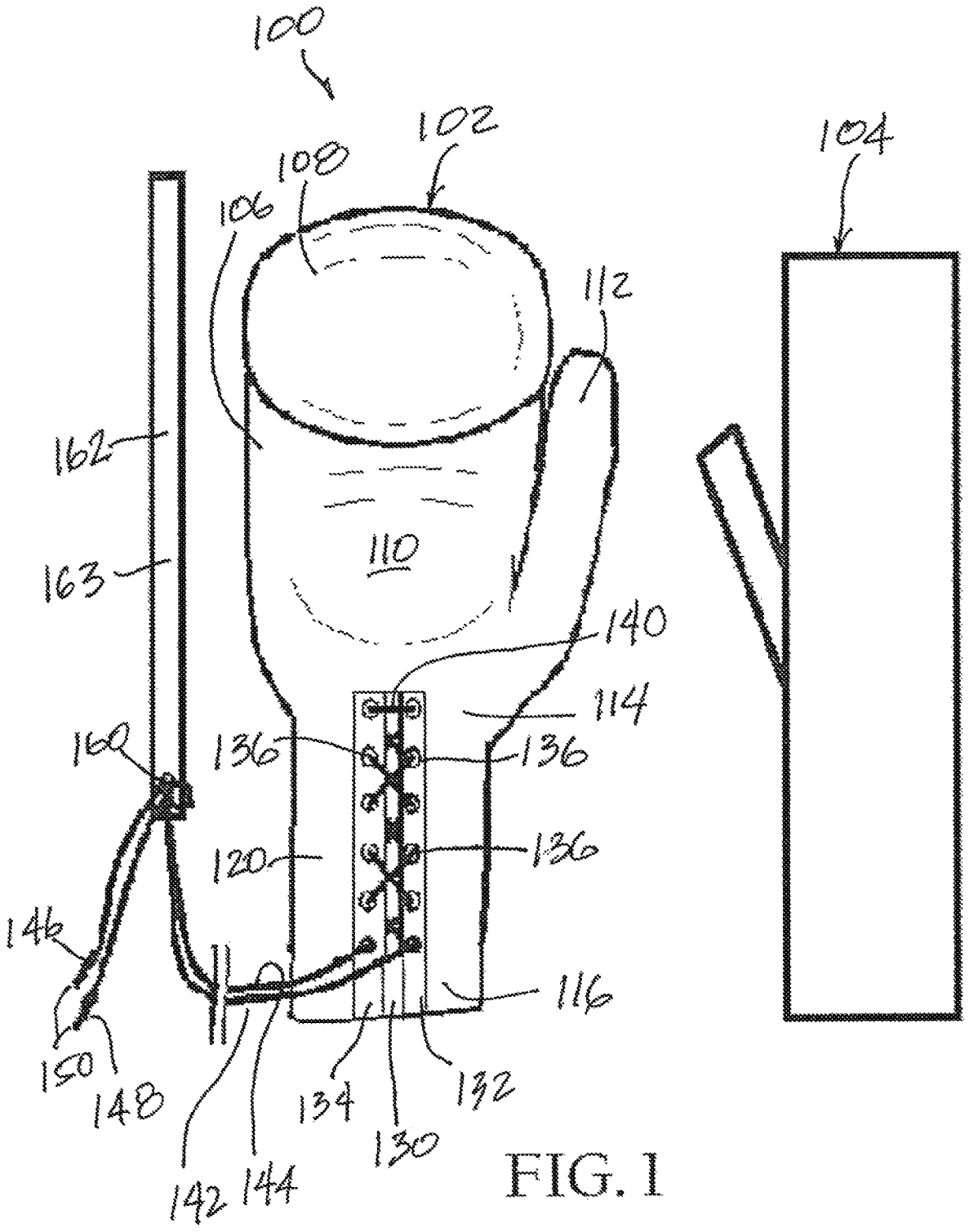
FIG. 1 is a schematic depiction of a boxing glove with a lace attached to a tying mechanism.

With reference now to FIG. 1, a pair of boxing gloves 100 are shown, which includes a right handed boxing glove 102 and a left handed boxing glove 104, the latter being shown schematically only. The boxing gloves 102, 104 can be any number of commercially available boxing gloves and can include sparing gloves, bagging gloves, and competing gloves. Further discussions below will be directed to the right handed glove 102 shown only, which are understood to apply equally to the left handed glove 104.

The boxing glove 102 comprises a body 106, such as a glove body, with a finger portion 108, a palm portion 110, a thumb portion 112, a wrist portion 114, and an opening portion 116, which has an opening or inlet for inserting a boxer's right hand into the interior of the glove body. Together, the wrist portion 114 and the opening portion 116 can be called a base portion 120. In an example, the base portion 120 has an elongated slit or channel 130 defined by two flaps 132, 134 with each flap having a plurality of eyelets 136. A tongue can be provided between the two flaps 132, 134 to provide a barrier between the flaps and the skin.

The eyelets shown can simply be small holes or openings formed through the material of the two flaps 132, 134 and usable for threading a lace or a string therethrough to retain the two flaps 132, 134 together. In other examples, the eyelets can be reinforced metal eyelets and can each comprise small metal pieces to reinforce a corresponding opening on the two flaps 132, 134. Grommets are similar to reinforced metal eyelets but typically used for more heavy duty material. Unless the context indicates otherwise, a lace and a string can be used synonymously, a slit and a channel at the base portion can be used synonymously, and an eyelet and a grommet can be used synonymously. An eyelet as used herein can be a small opening or an opening reinforced by one or more metal pieces to produce a reinforced opening.

A single lace 140 is shown in FIG. 1 laced through the plurality of eyelets 136 in a typical crossing pattern. In other examples, the stringing pattern or lacing pattern can be different, such as a knotted lacing pattern, a ladder lacing pattern, a hash lacing pattern, a diagonal lacing pattern, a bow tie lacing pattern, or a straight lace pattern. In still other examples, more than one lace 140 can be used to lace through the eyelets 136. The lace 140 has a length that is sufficient to lace through the eyelets 136 of the two flaps 132, 134 and extend beyond the last eyelet of each flap with two overhang lace sections 142, 144. Each overhang lace section has a terminal end or free end 146 or 148 with a reinforced tip 150, which is typically reinforced by tape, plastic coating, or similar elements. The two free ends 146, 148 can remain free prior to coupling to a fastener element 162 or can be tied or connected to one another prior to coupling to the fastener element 162.

The lace 140 should be long enough so that the two overhang lace sections 142, 144 can wrap at least partially around the base portion 120 of the glove 102. In some examples, the two overhang lace sections 142, 144 can wrap around at least one full revolution around the base portion 120 of the boxing glove, such as 1 to 1.2 revolutions, 1.5 revolutions, 2 revolutions, or a higher number of revolutions.

In an example, the two overhang lace sections 142, 144 are passed through an opening or through hole 160 of the anchoring mechanism or fastener element 162. In alternative embodiments, two or more openings 160 are provided with the fastener element 162 for looping the two overhang lace sections 142, 144 therethrough to secure the lace 140 to the fastener element 162. Each overhang section 142, 144 can loop through a respective opening of the multiple openings 160 fastener element, when two or more openings are incorporated, or in any pattern or method desired by the user for purposes of tying the lace 140 to the fastener element 162.

In an example, a back-to-back hook and loop element 163 can form the basis of the fastener element, for example a VELCRO® brand hook and loop length. A hook and loop element 163 having a length of about 8 inches to about 24 inches may be used with the lace 140 with other dimensions contemplated, such as being shorter than 8 inches or longer than 24 inches. The hook and loop width can be about ¾ inch to about 1.5 inches with other dimensions contemplated, such as being less than ¾ inch or greater than 1.5 inches. A back-to-back hook and loop system 163 forming the fastener element 162 of the present disclosure has the hook on one side or face of a strip and the loop on the other side or face of the strip of the fastener system. The hook is understood to be the rougher of the hook/loop fastening system, and the loop the softer of the two materials. The hole 160 on the fastener element 162 can be reinforced, such as with a metal eyelet. In other examples, there can be two or more holes 160 formed through the fastener element 162 so as to distribute the pulling forces over larger areas of the fastener element 162.

Figure 2:
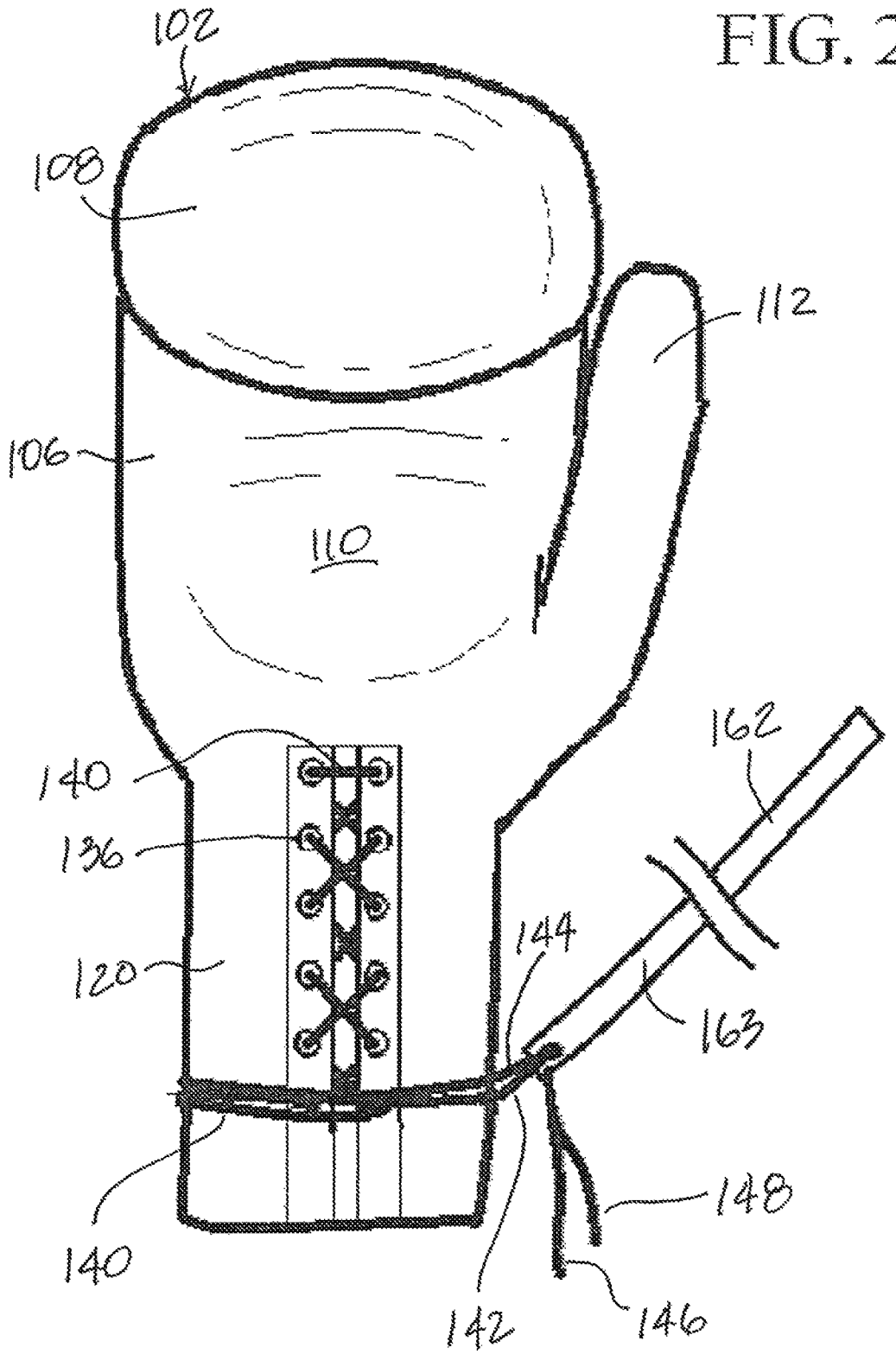
FIG. 2 is schematic depiction of the boxing glove of FIG. 1 with the lace wrapped around the base portion of the boxing glove.
Figure 3:
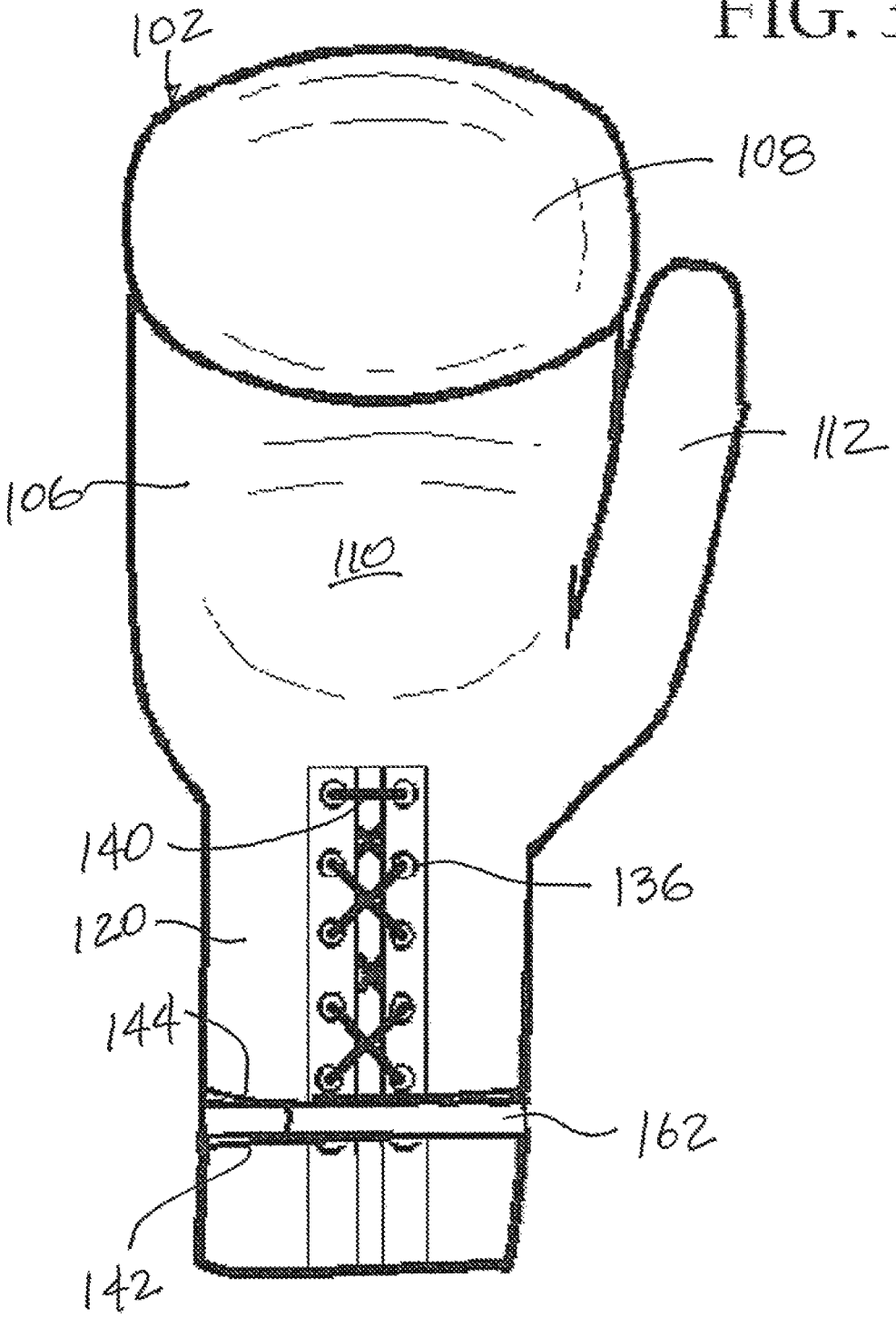
FIG. 3 is a schematic depiction of the boxing glove of FIG. 1 with the lace wrapped around the base portion of the boxing glove and the tying mechanism wrapped around the base portion of the boxing glove.

In use, a boxer, or a person that plans to wear the boxing gloves 100, places his or her right hand in through the opening portion 116 of the right handed glove 102 and into the interior of the body 106 and then pull on the two overhang lace sections 142, 144 of the lace 140 to pull the two flaps 132, 134 together so as to tighten the base portion 120 around the boxer's wrist and forearm. With further reference to FIG. 2 in addition to FIG. 1, the boxer then wraps the overhang lace sections 142, 144 around the base portion 120 of the glove 102 while maintaining a firm grip on the lace 140 so as to hold the lace in tension around the base portion 120. Once the two overhang lace sections 142, 144 are taken up by the partial, full, or greater than one wrapping revolution around the base portion, the boxer then continues to wrap the hook and loop system 163 of the fastener element 162 around the base portion 120 of the glove until the hook and the loop of the fastener element 162 can engage one another. The lace 140 is now tightened around the glove 102 as shown in FIG. 3 and the fastener element 162 activated to maintain the lace in the wrapped position. The engagement between the hook and loop of the fastener element 162 keeps the lace 140 tightly wrapped around the base portion 120 of the glove 120 without the need for a second person.

With reference again to FIG. 1, after the boxer successfully places the right handed glove 102 over the right hand, or the right hand into the right handed glove, and secures the lace 140 as described herein, the boxer can now place his or her left hand into the left handed boxing glove 104 (shown schematically in FIG. 1) and repeat the securing steps. Because no special dexterity is required to take up the tension of the lace and maintain the tension, as the lace is not required to be tied or knotted to maintain the tension around the base section 120, the boxer can repeat the securing steps by gripping the lace 140 and/or the fastener element 162 on the left handed glove 104 between the thumb portion 112 and the finger/palm portions of the right hand while the hand is located inside the right handed boxing glove 102 to secure the lace 140 of the left handed boxing glove 104 over the left hand. Once completed, the boxer is able to put on both the left and right handed boxing gloves by himself or herself without the aid of a second person to tie or knot the ends of the lace together, which is impossible to do without the aid of the lace and fastener element of the present embodiments.

Although the description refers to placement of the right hand into the right handed boxing glove first and then follow by the left hand into the left handed glove, the invention can be practiced in reverse, starting with the left hand and then the right hand.

Figure 4:
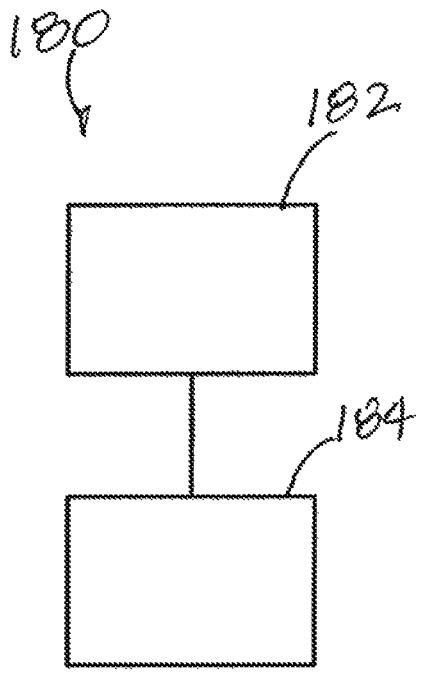
FIG. 4 is a process flow diagram for practicing tying or securing of a lace in accordance with aspects the present invention.

With reference now to FIG. 4, a process flow diagram or a diagram depicting method steps for practicing aspects of the present invention is shown, which is generally designated 180. The process 180 of FIG. 4 includes placing two overhang lace sections of a lace of a left handed boxing glove in mechanical connection or securement with a fastener element at 182. The fastener element 162 can comprise a back-to-back hook and loop element 163. Alternatively, the fastener element 162 can comprise a loop element and a hook element placed in contact with one another, which can be directly or indirectly in contact with one another. For example, one end of a strip having the hoop element can attach to an end of a strip having the hook element using conventional means, such as by sewing, stitching, gluing, or combinations thereof.

In another example, an intermediate piece can be placed between the strip having the loop element and the strip having the hook element. In an example, the intermediate piece located between the two strips can be any number of fabric, belt, or cloth material. In a particular example, the intermediate piece located between the two strips can be a stretchable material, an elastic belt, or a fabric. The intermediate piece can have a first end and a second end. The strip with the loop element can be attached to the first end of the intermediate piece and the strip with the hook element can be attached to the second end of the intermediate piece to join the pieces together. Sewing or stitching can be used to join or attach the two strips and the intermediate piece together with other alternatives contemplated, such as by gluing, bonding, or combinations thereof.

The process 180 further includes placing two overhang lace sections of a lace of a right handed boxing glove in mechanical connection or securement with a second fastener element at 184. The fastener element at step 184 can also be a back-to-back hook and loop element or can be a strip with the hook element attached to an end of a strip with the loop element, optionally with a connecting piece located therebetween. The process can reverse and start with the right handed boxing glove and then proceed to the left handed boxing glove.

In some examples, one overhang lace section of a lace is placed in mechanical connection or securement with a hook element while the other overhang lace section of the lace is placed in mechanical connection or securement with a loop element. This alternative process differs from using a back-to-back hook and loop element and produces a lace system with separate hook and loop elements.

Figure 5:
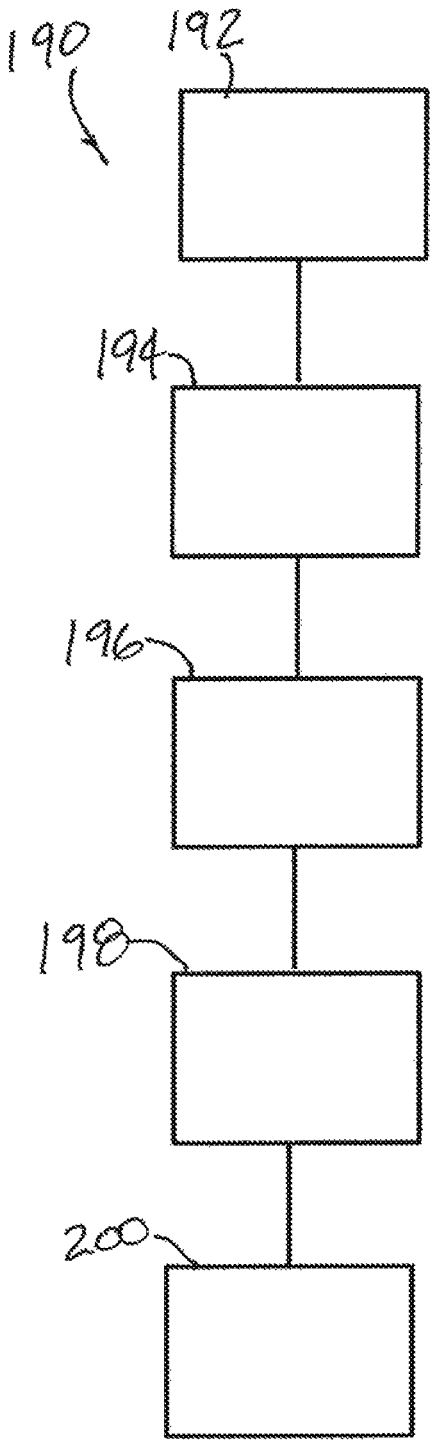
FIG. 5 is a process flow diagram for practicing tying or securing of a lace in accordance with further aspects of the present invention.

With reference now to FIG. 5, a further process flow diagram or a diagram depicting method steps for practicing aspects of the present invention is shown, which is generally designated 190. In an example, the process 190 includes first placing a left hand into a left handed boxing glove or a right hand into a right handed glove at 192, i.e., the first boxing glove, said boxing glove comprising a lace having two lace overhang sections attached to a fastener element, similar to one of the fastener elements 162 described elsewhere herein. The fastener element can be a back-to-back hook and loop fastener element, or a separate hook and loop element that are connected end-to-end to one another, either directly or indirectly with an intermediate piece therebetween.

At 194, the method includes wrapping the two lace overhang sections around the base portion of the boxing glove with the hand located inside and then continue to wrap around the base portion of the boxing glove so that the hook and loop element or elements of the boxing glove engage or secure to one another, as shown in FIGS. 1, 2, and 3 and as previously described. In some examples, the lace is pulled so that tension is maintain through at least part of the lace and the two flaps 132, 134 (FIG. 0.1) of the glove before securing the fastener element by attaching the hook element to the loop element.

At 196, the process further comprises placing the other one of the left hand or the right hand into the left handed boxing glove or the right handed glove, i.e., the second boxing glove, said boxing glove comprising a lace having two lace overhang sections attached to a fastener element, such as to a fastener element having a back-to-back hook and loop fastener element or a separate hook element connected to a loop element in an end-to-end arrangement, either directly or indirectly with an intermediate piece located therebetween. The process includes using the now secured hand inside the first boxing glove via steps 192 and 194 to grip a lace and/or a fastener element between the thumb portion and the finger/wrist portions of the boxing glove of the secured hand at 198.

At 200, the process further includes wrapping the two lace overhang sections of the second boxing glove around the base portion of the second boxing glove with the secured hand inside the first boxing glove while maintaining tension on the lace, or at least part of the lace. The process includes continuing wrapping the overhang sections of lace around the base portion so that the fastener element, such as a hook and loop element or separate hook and loop elements in an end-to-end arrangement, of the second boxing glove engage or secure to one another, as shown in FIGS. 1, 2, and 3 and as previously described. The steps provided by the process diagram 190 of FIG. 5 explains a unique and novel way for a boxer to place his or her hands into a left handed boxing glove and then a right handed boxing glove, or in the reverse, and then lace up the two boxing gloves without the assistance of another person.

Figure 6:
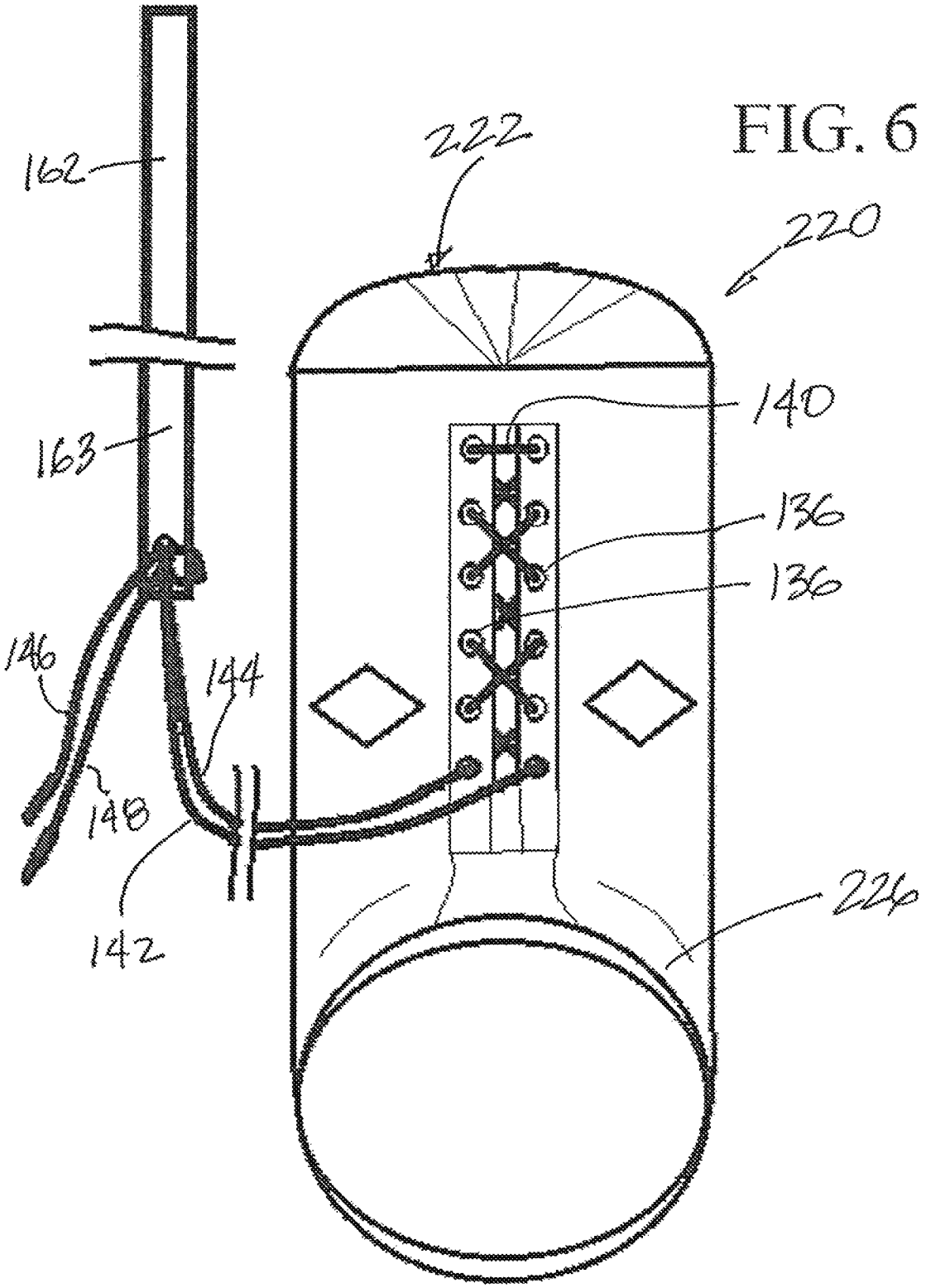
FIG. 6 is a schematic depiction of a pair of shoes (only one shown) with a lace attached to a tying mechanism.

FIG. 6 is a schematic depiction of a pair of shoes 220 (only one shown) having a lace 140 and an anchoring mechanism or fastener element 162 of the present invention, which can be a fastener element comprising a hook and loop element 163. In an example, the shoe 222, which can be a left shoe or a right shoe, can be a high-top shoe, a boot, a work boot, or a shoe that is other than a standard low-cut shoe and having a plurality of eyelets. The shoe can generically be called a high-top shoe and has an extended ankle support section 226.

The shoe 222 is shown with a plurality of eyelets 136 having a lace or a shoe string 140 laced through the plurality of eyelets. To wear the high-top shoe 222, the wearer can pull on the two overhang lace sections 142, 144 of the shoe lace 140 and then rather than tying a typical shoe lace knot to keep the lace in tension, the wearer can wrap the two overhang lace sections around the extended ankle support section 226 of the high-top shoe 222 until the hook engages the loop of the fastener element 162. The user can then repeat the steps with the second shoe of the pair of shoes 220.

With reference now to FIG. 7, the fastener element 162 of FIGS. 1-3 is more clearly shown with an opening 160 provided with the body 250 of the fastener element 162. The opening 160 can be formed with a puncher to create a hole near the first end 240 of the fastener element, opposite the second end 242 of the fastener element. The fastener element 162 can be formed with a back to back hook and loop element 163 or the body 250 can be formed by attaching a strip of hook element to a strip of a loop element, in an end-to-end or serial configuration, with or without an intermediate piece therebetween.

FIG. 8 shows a fastener element 162 that is similar to the fastener element 162 of FIG. 7 with a metal eyelet 246 to reinforce the opening 160 on the fastener element.

FIG. 9 depicts yet another fastener element 162 in accordance with further aspects of the present disclosure. As shown, the first end 240 of the fastener element 162 is wrapped around and attaches to the body 250 of the fastener element at an attached point 252, such as with stitching, sewing, bonding, and/or adhesive. This wrapped section 254 in combination with the attached point 252 forms a body loop 256 near the first end 240 of the fastener element 162. Two free ends of a lace can pass through the body loop 256 and then tied off to mechanically secure the lace to the fastener element of FIG. 9. The fastener element 162 of the present disclosure can be formed with a back to back hook and loop element 163 or the body 250 can be formed by attaching a strip of hook element to a strip of a loop element, in an end-to-end or serial configuration, with or without an intermediate piece therebetween. The first end 240 is shown spaced from an end-most point 258 of the body 250 of the fastener element 162.

With reference again to FIGS. 1 and 6, the fastener element 162 used herein can embody any of the fastener elements shown and described with reference to FIGS. 7-9.

In some examples, a lace can be laced through a plurality of eyelets on a shoe or a boxing glove differently than as shown in FIGS. 1-3 and 6 and is still usable with a fastener element 162 of the present invention. For example, the lace can be laced so that there is only one lace overhang and the one lace overhang connected to the fastener element 162 described elsewhere herein. In still other examples, the lace can have a different lacing pattern than the crossing pattern shown. In still other examples, after lacing a boxing glove or a shoe as described elsewhere herein, tape can be used to further secure the fastener element from inadvertently coming loose or coming undone.

FIG. 10 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein and uses a hook and loop element 163 but with some differences. In the present embodiment, a cover element 270 is attached to the body 250 of the fastener element 162, such as by stitching, sewing, adhesive, welding, or combinations thereof. The cover element 270 can be attached closer to the first end 240 of the body 250 than the second end 242 of the body. An opening 160 can be provided through both the cover element 270 and the body 250 of the fastener element 162 to receive one or two free ends of a lace 140 (FIG. 1). A reinforced metal eyelet can be included with the opening 160.

The cover element 270 can function as a smooth protective layer or surface and can embody any number of materials, including VELCRO compatible neoprene, neoprene, closed cell foam, polyester tricot loop, nylon knitted loop, nylon tricot, low pile loop fabric, unbroken loop fabric, Spandex and nylon jersey, Spandex and polyester Perfectex, Lycra fabric, heavy duty cotton, low density ethylene foam, and polyethylene foam. The cover element 270 is understood to have a relatively softer surface than that of the hook element and softer than the edges of the hook element or loop element. The cover element 270 can be incorporated so that when the lace 140 and fastener element 162 are wrapped around an object, such as around an extended ankle support system 226 of a shoe (FIG. 6) or around a base portion 120 of a boxing glove (FIG. 3), the cover element 270 does not scratch or otherwise damage the surfaces that the cover element comes into contact.

The cover element 270 can have a width that matches or closely corresponds to the width of the body 250 of the fastener element 162. The length of the cover element 270 can be selected so that some or all of the circumference to which the fastener element 162 wraps around, such as the base portion 120 of a boxing glove, contacts the cover element 270. In an example, the cover element 270 is attached to the hook side of a back-to-back hook and loop element 163, such as by stitching, sewing, bonding, adhesive, or combinations thereof.

The present fastener element 162 can include two edge liners 274, 274, one on each side edge 262, 262 of the fastener element 162. Each edge liner 274 can be a woven or non-woven cloth or fabric and can be attached to the respective side 262 of the body 250 by sewing, stitching, adhesive, bonding, or combinations thereof. In other examples, the two edge liners 274, 274 can be made from a thermoplastic foam material. The two edge liners 274, 274 can protect a user or wearer from the relatively hard surface of the edges of the body to prevent unwanted injuries or pain. The two edge liners 274, 274 can extend the remaining length of the body 250 along the two edges 262, 262 not covered by the cover element 270 or can extend the full length of the fastener element or any length in between. In an example, the two edge liners 274, 274 can be made from a polyester fabric or material.

Optionally, a gripper element 280 may be included at or near the second end 242 of the body 250. The gripper element 280 can be attached to the loop side of the fastener element so as to leave the hook side of the fastener element exposed at the second end 242 for securing against the loop element when the fastener element 162 is wrapped around an object, such as around the base of a boxing glove. When incorporated, the gripper element 280 provides a leverage point to facilitating separating the hook element from the loop element.

The gripper element 280, when incorporated, can embody a loop with a hole or opening in the middle thereof. In other examples, the gripper element 280 is an enlarged gripping structure or fabric for grabbing and pulling, with or without a loop. The gripper element 280 can be made from any number of materials, including from a woven or non-woven strip of fabric or cloth or from a string. In an example, the gripper element 280 is made from a polyester material.

FIG. 11 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein, such as the fastener element 162 of FIG. 10 with some differences. In the present embodiment, the gripper element 280 is omitted. Instead, a gripper pad 290 is provided at the second end 242. In an example, the gripper pad 290 is stitched, sewn, bonded, or glued to the body 250, including to the hook side of the fastener element. The gripper pad 290, which can have the same material as the cover element 270 or the edge liners 274, 274 or be made from a different material, can be used by the user or wearer to pry the hook from the loop of the fastener element to separate the fastener element from the object, such as from the boxing glove or shoe.

FIG. 12 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein, such as to the fastener element 162 of FIGS. 10 and 11 with some differences. In the present embodiment, the overall length of the fastener element 162 is made from at least two distinct materials or sections. The first section 302 can be made from a hook element 300 having a first end 240 and a second end 242. Optionally, the first section 302 can be a back-to-back hook/loop element. The second section 304 can be made from a loop element 310 with a built-in loop that is compatible with the hook element 300 of the first section 302 or from a loop element. For example, the loop element 310 can be a VELCRO hook/loop system or similar compatible neoprene, polyester tricot loop, nylon knitted loop, low pile loop fabric, unbroken loop fabric, etc. The second section 304 has a first end 318 attached to the first end 240 of the first section 302 and a second end 320 spaced from the first end 318. The first end 240 of the first section 302 and the first end 318 of the second section 304 can overlap and the stitching or sewing performed at the overlapped sections. The opening 160, which can be reinforced with a metal eyelet, is located closer to the second end 320 than to the first end 318 of the loop element 310. For simplicity, the first section 302 can be considered a hook element 300 and the second section 304 can be considered a loop element 310. A cover element 270, similar to those shown and described with reference to FIGS. 10 and 11, can be attached to the second section 304 to provide cushion, padding, or coverage upon contact with the shoe or boxing glove.

The first section 302 of the fastener element 162 may incorporate a gripper element 280 as described with reference to FIG. 10 or a gripper pad 290 as described with reference to FIG. 11. Optionally, the gripper element and the gripper pad can be omitted. The first section 302 and the second section 320 may attach to one another by stitching, sewing, bonding, adhesive or combinations thereof.

Thus, a fastener element described herein can have an overall length defined by a hook element, a loop element, or a combination hook/loop element. Optionally, an intermediate piece can be provided between a strip of a hook element and a strip of a loop element. The intermediate piece can be a stretchable material, an elastic belt, or a fabric. In other examples, the overall length of a fastener element can be defined by two or more distinct sections. For example, a length of the fastener element can be a loop element and another length of the fastener element can be a hook element, a loop element, or a combination hook/loop element.

Figure 13A:
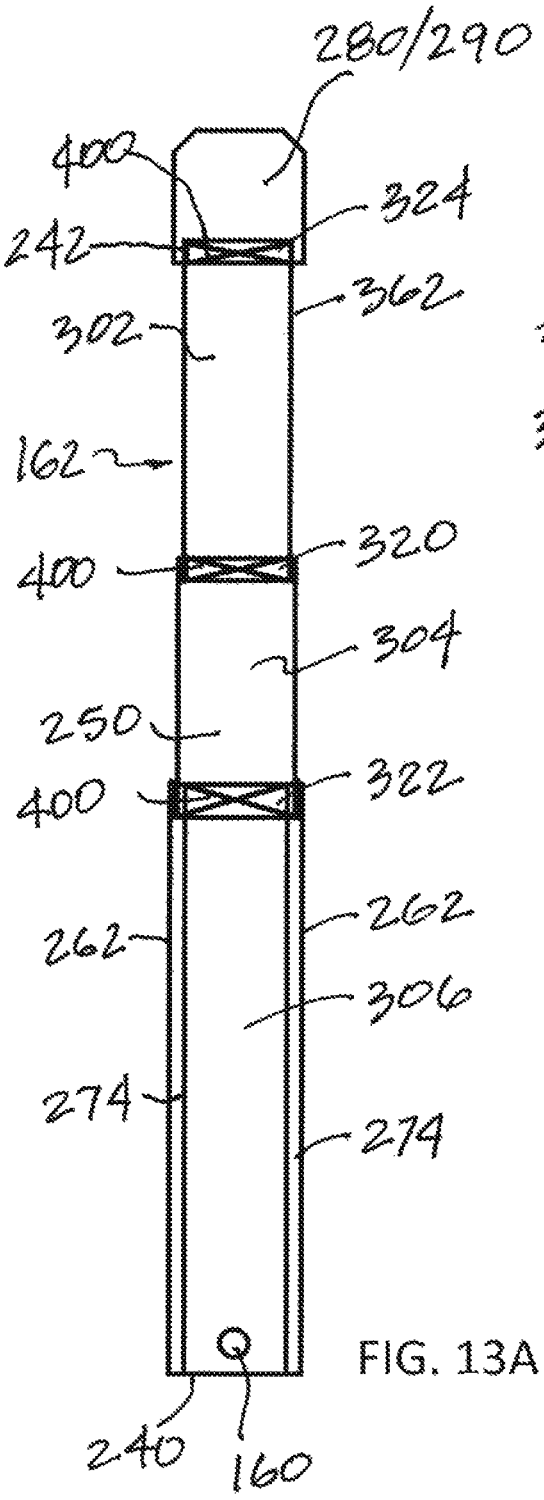
FIGS. 13A and 13B are schematic depictions of another embodiment of a fastener element.

With reference now to FIG. 13A, a fastener element 162 provided in accordance with further aspects of the present invention is shown, which is usable with a lace 140 having two free ends 146, 148, as disclosed elsewhere herein. The present fastener element 162 is similar to the other fastener elements described elsewhere herein, such as the fastener element 162 of FIGS. 10-12, and previously alluded to.

As shown, the fastener element 162 is made from a first section 302 attached to a second section 304, which is then attached to a third section 306. The first section 302 can overlap with the second section 304 at a first overlapped region 320. The first section 302 and the second section 304 can be secured together at the first overlapped region 320 by stitching, sewing, bonding, adhesive or combinations thereof, generally designated as 400.

The second section 304 can overlap with the third section 306 at a second overlapped region 322. The first section 302 and the second section 304 can be secured together at the second overlapped region 322 by stitching, sewing, bonding, adhesive or combinations thereof, generally designated as 400.

The fastener element 162 has a body 250 defined by the three sections 302, 304, 306. The body 250 has a first end 240 and a second end 242. An opening 160 can be provided with the body near the first end. The opening 160 can be a simple hole punched through the third section 306 or can be reinforced with a metal eyelet. A gripper element 280 or a gripper pad 290 can be provided and attached to the second end 242 of the body 250. In an example, the body 250 is provided with a gripper pad 290, which can overlap with the first section 302 at a third overlapped region 324. The first section 302 and the gripper element 280 or gripper pad 290 can be secured together at the third overlapped region 324 by stitching, sewing, bonding, adhesive or combinations thereof, generally designated as 400.

Figure 13B:
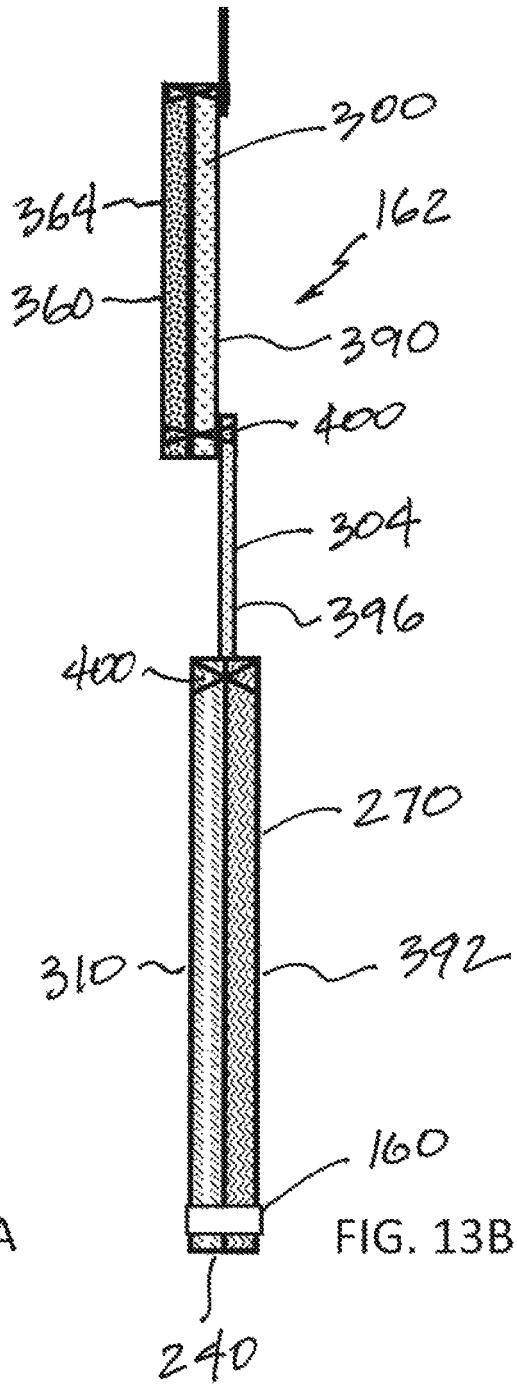

With continued reference to FIG. 13A and further reference to FIG. 13B, which is a schematic cross-sectional side view of FIG. 13A, the first section 302 can be made from a strip of a hook element 300 for attaching to a loop element. The length of the first section 302 can be about 3 inches to about 11 inches in length. The hook element 300 can optionally be provided with a backing material 360. The backing material 360 can attach to the hook element 300 around a perimeter 362 of the hook element, such as by stitching, sewing, bonding, adhesive, or combinations thereof.

In an example, the backing material can be made from a synthetic textile such as a from a nylon material, a polyester material or from Nomex. Optionally, the backing material 350 can be made from heavy duty cotton. In some examples, the exterior surface 364 of the backing material 360 can be printed or labeled with any number of information, such as manufacturer information, team logo, personalized prints, etc. When the fastener element 162 of FIGS. 13A and 13B is put to use, the exterior surface 352 and the optional printed information can be exposed and visually detectable.

In an example, the second section 304 can have a structure or body that is stretchable. For example, the second section 304 can be made from a stretchable material, an elastic belt, from Lycra, from Spandex, from Nylon Lycra fabric, or similar two dimensional or four dimensional stretchable fabrics. The second section 304, which can also be referred to as an intermediate piece, can have a length of between about 1.5 inches to about 6 inches. The second section 304 can comprise a strip of stretchable material. In some examples, the second section 304 can comprise two or more overlapping stretchable strips to increase the bulk and biasing capabilities of the second section.

The third section 306 is shown having two side edges 262 with each of the two side edges having an edge liner 274 attached thereto, similar to that of FIGS. 10-12. The third section 306 can include a trip of a loop element 310 and a cover element 270. The cover element 270 is similar to cover elements described elsewhere herein, such as the cover element 270 of FIGS. 10-12. A through hole or eyelet 160, which can be a punched hole or a metal reinforced eyelet, is provided near an end of the third section 306. Overhang lace sections of a lace can project through the eyelet 160 and secured thereto by knotting, as previously discussed. In some examples, there can be two or more eyelets for coupling with the overhang lace sections.

As shown, the hook element 300 is oriented in a first direction while the loop element 310 is oriented in a second direction, opposite the first direction. This arrangement allows the fastener element 162 shown in FIG. 13B to wrap around an object, such as a boxing glove, with the cover element 270 in contact with the object so that the loop element 310 is exposed for engagement by the hook element 300. The length of the third section 306 can be approximately 6 inches to about 14 inches.

In an example, the second section or intermediate piece 304 projects between the cover element 270 and the loop element 310 of the third piece 306 and then secured between the two by stitching, sewing, bonding, adhesive or combinations thereof. In other examples, the intermediate piece 304 can lie over or under the third section 306 and not between the cover element 270 and the loop element 310 of the third piece 306.

The fastener element 162 of FIGS. 13A and 13B is usable with a lace and maintaining tension on the lace as described elsewhere herein.

The fastener element 162 of FIGS. 13A and 13B can be viewed as having a first portion 390 configured for attaching to a second portion 392 of the fastener element. The first portion 390 of the fastener element is attached to an intermediate piece 396 and the second portion 392 of the fastener element 162 is attached to the intermediate piece 396. The first portion 390 and the second portion 392 are attached to one another through the intermediate piece 396. The intermediate piece 396 can comprise a single element or a single body or more than one elements. The first portion 390 and the second portion 392 are indirectly attached to one another. Optionally, the first portion 390 and the second portion 392 are directly attached to one another and the intermediate piece 396 is omitted.

Methods of making and of using the fastener elements and components thereof of the present disclosure are within the scope of the present invention.

Although limited embodiments of the lace, anchoring mechanisms or fastener elements, boxing gloves, and shoes and their components have been specifically described and illustrated herein, many modifications and variations will be apparent to those skilled in the art. Accordingly, it is to be understood that the lace, tying mechanisms, boxing gloves, and shoes and their components constructed according to principles of the disclosed device, system, and method may be embodied other than as specifically described herein. The disclosure is also defined in the following claims.

What is claimed is:

1. A boxing glove, said boxing glove comprising:

a body with a finger portion, a palm portion, a thumb portion, and a base portion having an opening for placement of a hand inside an interior of the body;

a plurality of eyelets or openings having a lace passing through at least a subset of the eyelets or openings, said lace comprising two lace sections at opposite ends of the lace with each lace section comprising a free end; and a fastener element having a body and wherein the two lace sections are attached to the body of the fastener element at an attachment location such that the two lace sections and the body of the fastener element are fixed relative to one another at the attachment location, which is spaced from the base portion of the body prior to wrapping the lace and the fastener element around the base portion.

2. The boxing glove of claim 1, wherein the fastener element comprises a back-to-back hook and loop element.

3. The boxing glove of claim 1, wherein the fastener element comprises a hook element and a loop element.

4. The boxing glove of claim 2, further comprising a cover element having a protective surface attached to the fastener element.

5. A boxing glove, said boxing glove comprising:

a body with a finger portion, a palm portion, a thumb portion, and a base portion having an opening for placement of a hand inside an interior of the body;

a plurality of eyelets or openings having a lace passing through at least a subset of the eyelets or openings, said lace comprising two overhang lace sections and two free ends;

a fastener element having a body and wherein the two overhang lace sections are attached to the body of the fastener element; and at least one edge liner attached to an edge of the fastener element.

6. The boxing glove of claim 5, further comprising a gripper element attached to an end of the fastener element.

7. The boxing glove of claim 1, wherein the fastener element has a first section attached to a second section and the second section attached to a third section, and wherein the second section is made from a stretchable material.

8. The boxing glove of claim 7, wherein the first section comprises a hook element and the third section comprises a loop element.

9. The boxing glove of claim 8, further comprising a gripper element or a gripper pad attached to the first section and an eyelet located at the third section.

10. A method for lacing up a boxing glove comprising:

placing a hand through an interior of the boxing glove;

pulling on a free end of a lace to create tension on the lace, said lace comprising at least one lace section at the free end attached to a fastener element;

maintaining tension on the lace by pulling on the fastener element;

wrapping the lace and the fastener element around a base portion of the boxing glove; and securing the lace while maintaining the tension on the lace by securing a first portion of the fastener to a second portion of the fastener element.

11. The method of claim 10, wherein the fastener element comprises a hook element and a loop element.

12. The method of claim 10, wherein the first portion of the fastener element is attached to an intermediate piece and the second portion of the fastener element is attached to the intermediate piece.

13. The method of claim 12, wherein the at least one lace section projects through an eyelet located with the second portion and a second lace section projects through the eyelet.

14. The method of claim 10, wherein the first portion of the fastener element comprises a hook element and a backing and the second portion of the fastener element comprises a loop element and a cover element.

15. The method of claim 13, wherein the intermediate piece is made from a stretchable material.

16. The method of claim 10, wherein the boxing glove is a first boxing glove and the method further comprising grasping a second fastener element secured to a second boxing glove.

17. The method of claim 5, wherein securing the tension on the lace is maintained by securing the first portion of the fastener to the second portion of the fastener element without tying the lace to itself.

18. The boxing glove of claim 5, wherein the fastener element comprises a hook element and a loop element.

19. The boxing glove of claim 1, wherein the fastener element has a first end attached to the lace and a second end remote from the first end, and wherein a pulling force at the second end causes a pulling force on two sections of the lace.

20. The boxing glove of claim 1, wherein the two lace sections are tied to the body of the fastener element at the attachment location, which has a hole having the lace sections passing therethrough.

21. The boxing glove of claim 1, further comprising at least one edge liner attached to an edge of the fastener element.

* * * * *